United States Patent [19]

Barre

[11] Patent Number: 4,824,176

[45] Date of Patent: Apr. 25, 1989

[54] MILLING ENGINE FOR EXCAVATING TRENCHES IN THE GROUND

[75] Inventor: Daniel Barre, Moret sur Loing, France

[73] Assignee: Soletanche, Nanterre, France

[21] Appl. No.: 98,389

[22] Filed: Sep. 17, 1987

[30] Foreign Application Priority Data

Oct. 8, 1986 [FR] France ..... 86 14003

[51] Int. Cl.[4] ..... F21C 1/00

[52] U.S. Cl. ..... 299/59; 175/91; 175/96

[58] Field of Search ..... 175/95, 96, 91; 299/59; 37/94, 189, 190

[56] References Cited

U.S. PATENT DOCUMENTS 4,718,731 1/1988 Bauer et al. ..... 299/85

FOREIGN PATENT DOCUMENTS 1634262 9/1970 Fed. Rep. of Germany .
2362425 1/1975 Fed. Rep. of Germany .
2349688 11/1977 France .
2578876 9/1986 France .

*Primary Examiner*—Edgar S. Burr
*Assistant Examiner*—James Lisehora
*Attorney, Agent, or Firm*—Schweitzer & Cornman

[57] ABSTRACT

A milling engine for cutting trenches in ground or soil provided with at least one vertical support plate on both sides of which milling drums are supported for rotation about an axis perpendicular to said plate. One or more movable fingers are mounted on the lower edge of the plate for oscillating movement aobut the central axis of the plate during the rotation of the drums to remove a web of soil beneath the plate. Oscillation of the fingers is effected through camming surfaces formed on opposing inner ends of the drums which camming surfaces cooperate with a cam disposed at the inner ends of said movable fingers.

5 Claims, 1 Drawing Sheet

MILLING ENGINE FOR EXCAVATING TRENCHES IN THE GROUND

BACKGROUND OF THE INVENTION

The present invention relates to a milling or cutting engine for excavating trenches in the ground, and more particularly such an engine of the type having at least one substantially vertical support plate on each side of which two cutting milling drums are mounted for rotation about an axis substantially perpendicular to the plate.

Machines of this type are already known, which generally have two support plates, holding four milling drums turning inversely in pairs so as to bring the excavated dirt toward an aspirating nozzle situated at the axis of the machine.

As the capacity of such milling engines is increased, it becomes necessary to increase the thickness of the plate, which has to withstand the stresses placed on the milling drums by the ground.

This thickness of the plate creates difficulties in cutting the trench. The cutting tools mounted on the two milling drums beside the plate must be sufficiently apart from one another to accommodate the advance of the plate as the milling drums revolve. The result is the formation of a soil web on the bottom of the trench, the web having a width generally equal at least to that of the plate.

When the milling engine is lowered, the bottom edge of the plate abuts against this web and can therefore stop the progress of the cut.

A variety of solutions to this problem have been proposed. Consideration has been given to mounting the cutting tools situated beside the plate so as to move on the milling drums, so as to bring these tools on the two milling drums against one another when they are in a position clear of the plate. This solution, however, has proven difficult to realize inasmuch as the axes of the articulation of these tools must be able to withstand extremely great stresses.

Circular grooves have also ben created in the plate, centered about the axis of the milling drums, so that the cutting tools mounted fixedly on the milling drums will be separated by a distance less than the thickness of the plate. This solution has proven somewhat satisfactory, however, with the plate thicknesses presently used, it still is true that the web remains sufficiently large to withstand the weight of the milling engine applied through the bottom surface of the edge of the plate.

SUMMARY OF THE PRESENT INVENTION

The present invention purports to provide a different and better solution to the problem set forth above, or possible use in combination with the excavating means already known.

To this effect, the subject matter of the invention is a milling engine for cutting trenches in the ground, of a type having at least one substantially vertical support plate on each side of which two milling drums are mounted for rotation about an axis substantially perpendiculr to the plate, characterized by the fact that at least one movable finger is mounted at the bottom edge of the said plate, driving means being provided to cause the finger to oscillate from side to side of the center plane of the plate while the drums are rotating.

Thus, the fingers according to the invention come in contact with the vertical walls of the web, on which they exercise a lateral component of force which tends to break up this web.

Consequently, independently of the means that might permit reducing the thickness of the soil web, the present invention makes it more easily possible to break up this web and provide for easier penetration of the milling engine.

In order to provide a simple mounting offering good resistance to shock and wear, the fingers may be mounted on the bottom edge of the plate through the use of resilient means.

As a variant, any mechanical means may be used, such as articulations.

In one particular embodiment of the invention, the driving means may include cams placed on the sides of the milling drums situated facing the plate, these cams being in particular substantially continuous and sinusoidal.

Preferably, the milling engine according to the invention has a plurality of fingers mounted on the bottom edge of the support place, the driving means being arranged so that the successive fingers will swing in opposite directions with respect to the central plane of the plate.

Thus, the lateral forces applied by the fingers of the milling engine to the web may have a substantially zero lateral component, which prevents deflections of the engine and therefore assures the verticality of the trench.

One particular embodiment of the invention will now be described by way of non-limiting example, in conjunction with the appended diagrammatic drawings wherein:

DETAILED DESCRIPTION OF THE INVENTION

Figure 1:
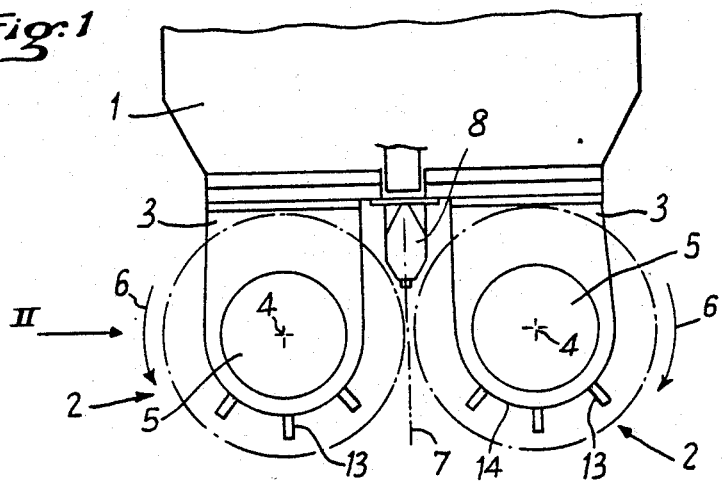
FIG. 1 is a side view of the lower part of the milling engine according to the invention.

The milling engine represented in FIG. 1 includes, in a known manner, a frame 1 at the bottom of which are mounted two milling drums 2 on a vertical support plates 3. The axes 4 of rotation of the drums are perpendicular to the plates 3. In the present case, hydraulic motors 5 are mounted on the plates 3 and their output shafts are attached to drums 2 so as to make them turn inversely in the direction of the arrows 6. Thus, the soil loosened by the drums 2 is brought toward the lateral axis 7 of the milling engine where it is aspirated by the aspirating nozzle 8.

Figure 2:
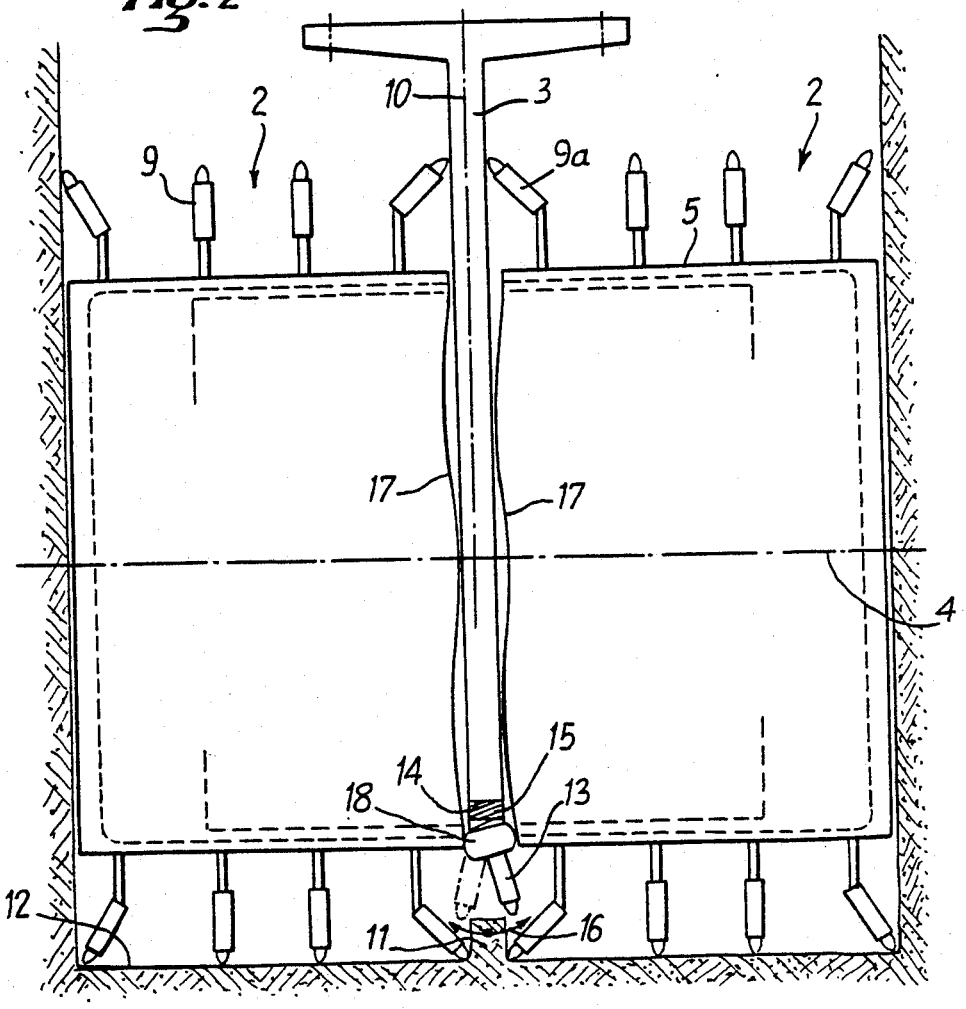
FIG. 2 is a view on a larger scale as seen in the direction of the arrow II of FIG. 1.

As shown in FIG. 2, the milling drums 2 have on their periphery the milling picks 9 which tear the soil apart as the drums rotate. The picks 9a closest to the plate 3 are inclined toward the transverse axis 10 of this plate so as to be as close as possible thereto.

When the drums 2 rotate and the milling engine is lowered, a soil web 11 nevertheless forms at the bottom of the trench 12, and its thickness is at least equal to the thickness of the plate 3, and the bottom edge of the plate 3 may abut against it when the engine is lowered.

In order to break up this soil web 11, fingers 13 are mounted on the semicircular bottom edge 14 of each plate 3. The fingers 13 are oriented substantially perpendicularly to the edge 14 on which they are mounted by means of resilient blocks 15, so as to permit them to oscillate according to the arrow 16 on either side of the central plane of the plate 3.

The inside edges of the drums 2, situated facing the plate 3, are cut according to a continuous sinusoidal profile 17 so as to form two guiding or cam surfaces between which is disposed a head 18 of the finger 13.

Thus, as the drums 2 revolve in the direction indicated by the arrows 6, the fingers 13 oscillate in the direction of the arrow 16, thus destroying the web 11, as represented in FIG. 2.

The surfaces 17 are arranged such that the movements of two fingers 13 disposed consecutively on a surface 14 are performed in opposite phases on either side of the plate 10. Thus, the fingers 13 apply, on the one hand, transverse forces, and on the other hand, torsional forces. These forces produce the breakage of the web 11 such that the latter is unable to stop the progress of the milling of the trench. Moreover, the opposite-phase movements involve no transverse forces on the milling engine, so that the latter is not deflected from the vertical as it advances.

Different variants and modifications may, of course, be given to the above description without thereby departing from the spirit and scope of the invention.

In particular, known means may be employed for the purpose of reducing the thickness of the soil web before it is broken up by the means of the invention.

Likewise, the milling drums, which have been described as driven by hydraulic motors situated in their hubs, may be driven by any other means, such as, for example, by chains connected to motors disposed in the frame.

I claim:

1. A milling engine for excavating trenches in the ground comprising:

(a) at least one substantially vertical thick support plate (3) having a lower edge, said plate being aligned along a central plane (10);

(b) a horizontal axis substantially perpendicular to said plate, first and second milling drums (2) mounted on opposite sides of said plate, said drums being rotatable about said horizontal axis (4);

(c) at least one movable finger (13) mounted between said drums on said lower edge of said plate, and driving means on said drums causing oscillation of said finger through said central plane (10) responsive to rotation of said first and second drums.

2. A milling engine according to claim 1, including plural pairs of drums and a plurality of fingers mounted on said lower edge of said thick plate, said driving means being arranged so that successive ones of said fingers oscillate in phase opposition.

3. A milling engine according to claim 1, further including (a) resilient means (15) disposed within said plate (3)

(b) said movable finger is mounted on the bottom edge of the plate through said resilient means.

4. A milling engine according to claim 1, in which (a) said first and second milling drums have inner edges facing said support plate, (b) said driving means include camming surfaces (17) found on said inner edges.

5. A milling engine according to claim 4, in which said camming surfaces are substantially continuous.

* * * * *